US010719039B2

(12) United States Patent
Tokutake et al.

(10) Patent No.: US 10,719,039 B2
(45) Date of Patent: Jul. 21, 2020

(54) IMAGE FORMING APPARATUS INCLUDING A SECOND POWER SUPPLY THAT APPLIES A VOLTAGE WITH A SAME POLARITY AS A TONER TO A DISCHARGING MEMBER TO CHARGE TONER ON A SECONDARY TRANSFER ROLLER

(71) Applicant: Konica Minolta, Inc., Tokyo (JP)

(72) Inventors: Shinya Tokutake, Okazaki (JP); Hidetoshi Noguchi, Tahara (JP); Kazuyoshi Ota, Chiryu (JP); Masanori Kawada, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/281,245

(22) Filed: Feb. 21, 2019

(65) Prior Publication Data

US 2019/0286020 A1 Sep. 19, 2019

(30) Foreign Application Priority Data

Mar. 19, 2018 (JP) ..... 2018-050984

(51) Int. Cl.
*G03G 15/16* (2006.01)
*G03G 15/00* (2006.01)
*G03G 21/00* (2006.01)

(52) U.S. Cl.
CPC ..... *G03G 15/1675* (2013.01); *G03G 15/168* (2013.01); *G03G 15/5004* (2013.01); *G03G 21/0011* (2013.01); *G03G 2221/0005* (2013.01)

(58) Field of Classification Search
CPC ..... G03G 15/1675; G03G 15/168; G03G 15/5004; G03G 21/0011; G03G 21/0023; G03G 2215/1652; G03G 2221/0005
See application file for complete search history.

(56) References Cited

U.S. PATENT DOCUMENTS

2007/0172267 A1* 7/2007 Nishida ..... G03G 15/161 399/302
2017/0205754 A1* 7/2017 Tabata ..... G03G 15/1605
2017/0351200 A1* 12/2017 Matsuzaki ..... G03G 15/1615
2018/0059602 A1* 3/2018 Minato ..... G03G 15/1605

FOREIGN PATENT DOCUMENTS

JP 2013-105145 A 5/2013

* cited by examiner

*Primary Examiner* — Joseph S Wong
(74) *Attorney, Agent, or Firm* — Lucas & Mercanti, LLP

(57) ABSTRACT

An image formation apparatus includes: an image carrier having a surface on which a toner image is formed; a transfer roller cooperating with a surface of the image carrier to form a nip at a first position in a direction in which the image carrier rotates; a discharging member provided at a second position downstream of the nip in a direction in which the transfer roller rotates; a first power supply that applies a first voltage opposite in polarity to toner to the transfer roller to transfer the toner image to a recording medium when the recording medium is inserted in the nip; and a second power supply that applies a second voltage identical in polarity to the toner to the discharging member to cause an electric discharge to electrically charge the toner on the surface of the transfer roller to electrically attract the toner to the transfer roller.

18 Claims, 13 Drawing Sheets

IMAGE FORMING APPARATUS INCLUDING A SECOND POWER SUPPLY THAT APPLIES A VOLTAGE WITH A SAME POLARITY AS A TONER TO A DISCHARGING MEMBER TO CHARGE TONER ON A SECONDARY TRANSFER ROLLER

The entire disclosure of Japanese Patent Application No. 2018-050984, filed on Mar. 19, 2018 is incorporated herein by reference in its entirety.

BACKGROUND

Technological Field

The present disclosure relates to an image formation apparatus, and more specifically to an image formation apparatus which transfers a toner image formed on an image carrier to a recording medium.

Description of the Related Art

In an image formation apparatus provided with a secondary transfer roller of a type which is constantly pressed into contact with an intermediate transfer belt (or an image carrier), when a patch image is formed on the intermediate transfer belt, the patch image comes into contact with the secondary transfer roller at a secondary transfer position (or a nip) and the patch image's toner would adhere to the secondary transfer roller. When the secondary transfer roller has toner adhering thereto, and in that condition, next printing is performed on a sheet (or recording media) the sheet has a back surface smeared with the toner.

As a countermeasure against this, a first method is applied as follows: when a patch image comes into contact with the secondary transfer roller, a voltage identical in polarity to the toner is applied to the secondary transfer roller to prevent the toner from adhering to the secondary transfer roller. However, even if this first method is performed, some toner would adhere to the secondary transfer roller.

Accordingly, for example, Japanese Laid-Open Patent Publication No. 2013-105145 discloses a second method as follows: after the first method is performed, a positive voltage and a negative voltage are alternately and repeatedly applied to the secondary transfer roller to move the toner adhering to the secondary transfer roller to the intermediate transfer belt to thus clean the secondary transfer roller.

SUMMARY

In the second method, however, a major portion of the toner adhering to the secondary transfer roller is electrically weakly charged and accordingly, not electrically movable, and the amount of toner which can be removed by applying voltage once is a small amount, so that it is necessary to apply voltage many times. This results in a long waiting time and may hence impair productivity.

A main object of the present invention is to provide an image formation apparatus which can prevent a recording medium from having a smeared back surface and thus achieve high productivity.

To achieve at least one of the abovementioned objects, according to an aspect of the present disclosure, an image formation apparatus reflecting one aspect of the present invention comprises: an image carrier rotatably driven and having a surface on which a toner image is formed; a first transfer roller cooperating with a surface of the image carrier to form a nip at a first position in a direction in which the image carrier rotates; a discharging member provided at a second position downstream of the nip in a direction in which the first transfer roller rotates; a first power supply that applies a first voltage opposite in polarity to toner to the first transfer roller to transfer the toner image to a recording medium when the recording medium is inserted in the nip; and a second power supply that applies a second voltage identical in polarity to the toner to the discharging member to cause an electric discharge to electrically charge the toner on a surface of the first transfer roller to electrically attract the toner to the first transfer roller.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
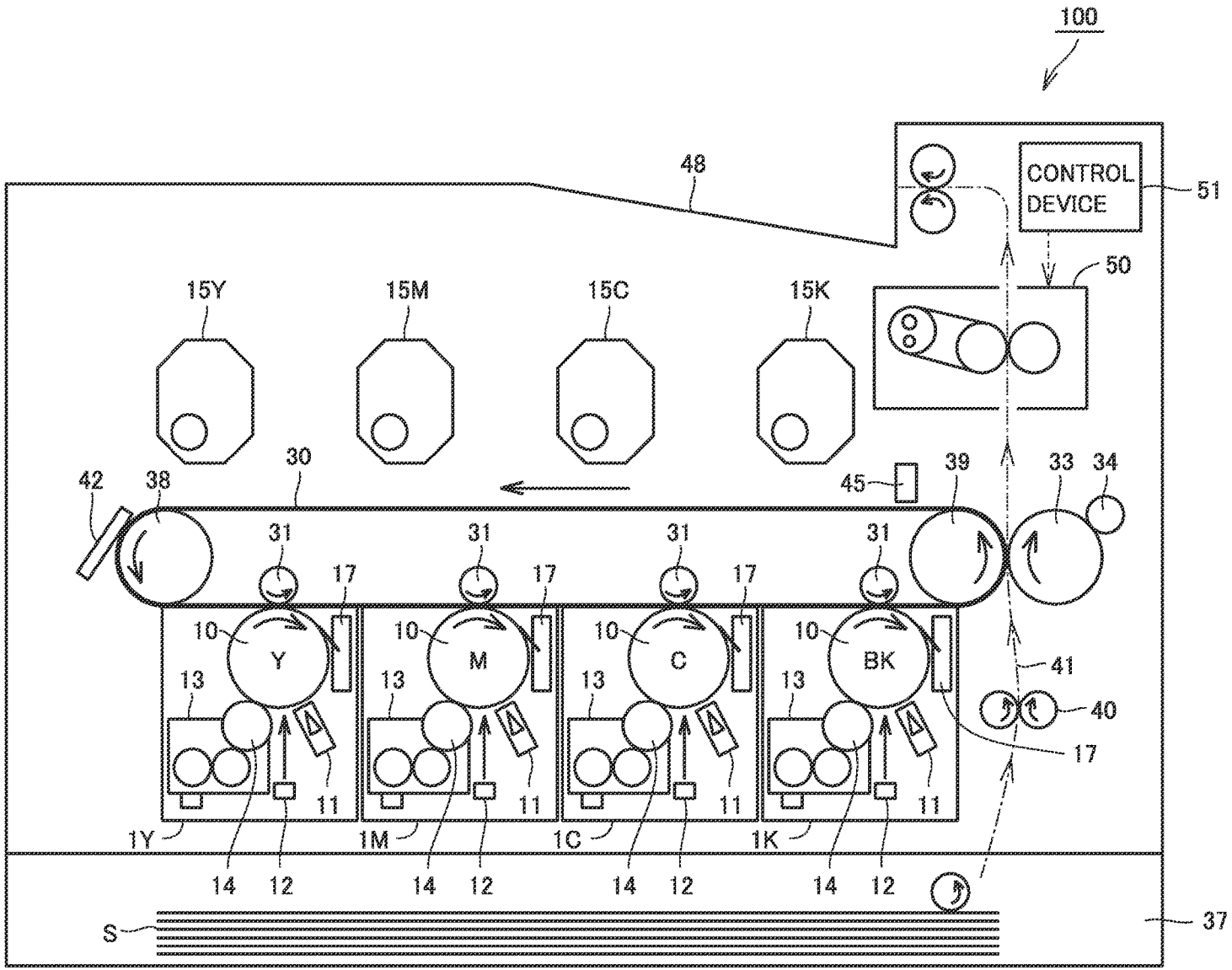
FIG. 1 generally shows a configuration of an image formation apparatus according to a first embodiment of the present invention.

FIG. 1 generally shows a configuration of an image formation apparatus 100 according to a first embodiment of the present invention. Image formation apparatus 100 as a color printer is shown in FIG. 1. Hereinafter, while image formation apparatus 100 as a color printer will be described, image formation apparatus 100 is not limited to the color printer. For example, image formation apparatus 100 may be a monochrome printer, a fax, or a multi-functional peripheral (MFP) of a monochrome printer, a color printer and a fax.

In FIG. 1, image formation apparatus 100 includes an intermediate transfer belt 30 (an image carrier), image forming units 1Y, 1M, 1C and 1K, toner bottles 15Y, 15M, 15C and 15K, a primary transfer roller 31 (a second transfer roller), a secondary transfer roller 33 (a first transfer roller), a discharging member 34, a cassette 37 (a sheet feeding unit), a driven roller 38, a driving roller 39, a timing roller 40, a cleaning blade 42 (a cleaning unit), an optical sensor 45, a tray 48, a fixing device 50, and a control device 51.

Intermediate transfer belt 30 is tensioned and thus engaged on driven roller 38 and driving roller 39 horizontally. Driving roller 39 is connected to a motor (not shown). Intermediate transfer belt 30 and driven roller 38 are ganged with driving roller 39 and thus rotated. FIG. 1 shows a case where intermediate transfer belt 30 rotates counterclockwise.

Image forming units 1Y, 1M, 1C, and 1K are disposed under intermediate transfer belt 30 successively in a direction in which intermediate transfer belt 30 rotates. Toner bottles 15Y, 15M, 15C, and 15K contain toners of yellow (Y), magenta (M), cyan (C), and black (BK), respectively.

Image forming unit 1Y receives toner supplied front toner bottle 15Y to form a yellow toner image. Image forming unit 1M receives toner supplied from toner bottle 15M to form a magenta toner image. Image forming unit 1C receives toner supplied from toner bottle 15C to form a cyan toner image. Image forming unit 1K receives toner supplied from toner bottle 15K to form a black toner image.

Image forming units 1Y, 1M, 1C, and 1K each include a photoreceptor 10, a charger 11, an exposure unit 12, a developing unit 13, and a cleaning blade 17. Charger 11 electrically charges a surface of photoreceptor 10 uniformly. Exposure unit 12 operates in response to a control signal received from control device 51 to emit a laser beam to photoreceptor 10 to expose a surface of photoreceptor 10 to light according to an input image pattern. Thus, an electrostatic latent image corresponding to an input image is formed on the surface of photoreceptor 10.

Developing unit 13 applies a developing bias to a developing roller 14 while rotating developing roller 14 to cause toner to adhere to a surface of developing roller 14. Thus, the electrically charged toner is transferred from developing roller 14 to photoreceptor 10, and a toner image depending on an electrostatic latent image is developed on a surface of photoreceptor 10. Photoreceptor 10 and a surface of intermediate transfer belt 30 are in contact with each other.

Cleaning blade 17 is pressed into contact with photoreceptor 10. Cleaning blade 17 collects toner which remains on a surface of photoreceptor 10 after a toner image is transferred from photoreceptor 10 to intermediate transfer belt 30.

Primary transfer roller 31 is provided to correspond to each image forming unit 1, and is rotatably supported in contact with a back surface of intermediate transfer belt 30. Primary transfer roller 31 and photoreceptor 10 of image forming unit 1 associated therewith sandwich intermediate transfer belt 30. When a transferring voltage opposite in polarity to the toner image is applied to primarily transfer roller 31, the toner image is transferred from photoreceptor 10 to a surface of intermediate transfer belt 30.

A toner image of yellow (Y), a toner image of magenta (M), a toner image of cyan (C), and a toner image of black (BK) are superposed, one on another, sequentially and thus transferred from photoreceptor 10 to intermediate transfer belt 30. Thus, a color toner image is formed on a surface of intermediate transfer belt 30.

At a predetermined position (a first position) downstream of image forming unit 1K, secondary transfer roller 33 is rotatably supported in contact with a surface of intermediate transfer belt 30. Secondary transfer roller 33 and driving roller 39 sandwich intermediate transfer belt 30. Secondary transfer roller 33 and intermediate transfer belt 30 are in contact with each other, and a portion at which they are in contact with each other is referred to as a nip. When intermediate transfer belt 30 is rotatably driven, the toner image on the surface of intermediate transfer belt 30 is transported to the nip between secondary transfer roller 33 and intermediate transfer belt 30.

Discharging member 34 is provided at a predetermined position (a second position) downstream of the nip in the direction in which secondary transfer roller 33 rotates. Discharging member 34 is provided to electrically charge the toner adhering to the surface of secondary transfer roller 33 to electrically attract the toner to secondary transfer roller 33 to prevent paper S from having the back surface smeared therewith.

A large number of sheets S (or recording media) are set in cassette 37. Each sheet S is sent from cassette 37 by timing roller 40 along transport path 41 to the nip between secondary transfer roller 33 and intermediate transfer belt 30. Control device 51 controls a transferring voltage applied to secondary transfer roller 33 in accordance with a timing of sending out sheet S.

When sheet S is inserted between secondary transfer roller 33 and the toner image on the surface of intermediate transfer belt 30 and in that condition a transferring voltage opposite in polarity to the toner image is applied to secondary transfer roller 33, the toner image is attracted from intermediate transfer belt 30 toward secondary transfer roller 33 and thus transferred to a surface of sheet S. Timing to transport sheet S to secondary transfer roller 33 is controlled by timing roller 40 in accordance with the position of the toner image on intermediate transfer belt 30. As a consequence, the toner image on intermediate transfer belt 30 is transferred to an appropriate position on sheet S.

Sheet S with the toner image transferred thereon is sent to fixing device 50 located above. Fixing device 50 applies pressure to and heat sheet S passing therethrough. In response to a control signal from control device 51, fixing device 50 controls the degree of heating the sheet, the pressure applied to the sheet and the like. By fixing device 50 heating and applying pressure to sheet S, the toner image is fixed on sheet S. Subsequently, sheet S is discharged to tray 48.

Optical sensor 45 is provided to face a surface of intermediate transfer belt 30 at a predetermined position downstream of the nip between secondary transfer roller 33 and intermediate transfer belt 30. Optical sensor 45 senses in density a patch image formed on a surface of intermediate transfer belt 30 separately from a toner image. Control device 51 adjusts a developing bias voltage or the like, based on a detection result from optical sensor 45, to adjust a toner image in density.

Further, cleaning blade 42 is pressed against intermediate transfer belt 30 at a predetermined position (a third position) downstream of optical sensor 45. Cleaning blade 42 and driven roller 38 sandwich intermediate transfer belt 30. Cleaning blade 42 collects toner remaining on a surface of intermediate transfer belt 30 after a toner image is transferred from intermediate transfer belt 30 to sheet S. The recovered toner is transported by a transporting screw (not shown) and stored in a waste toner container (not shown).

Figure 2:
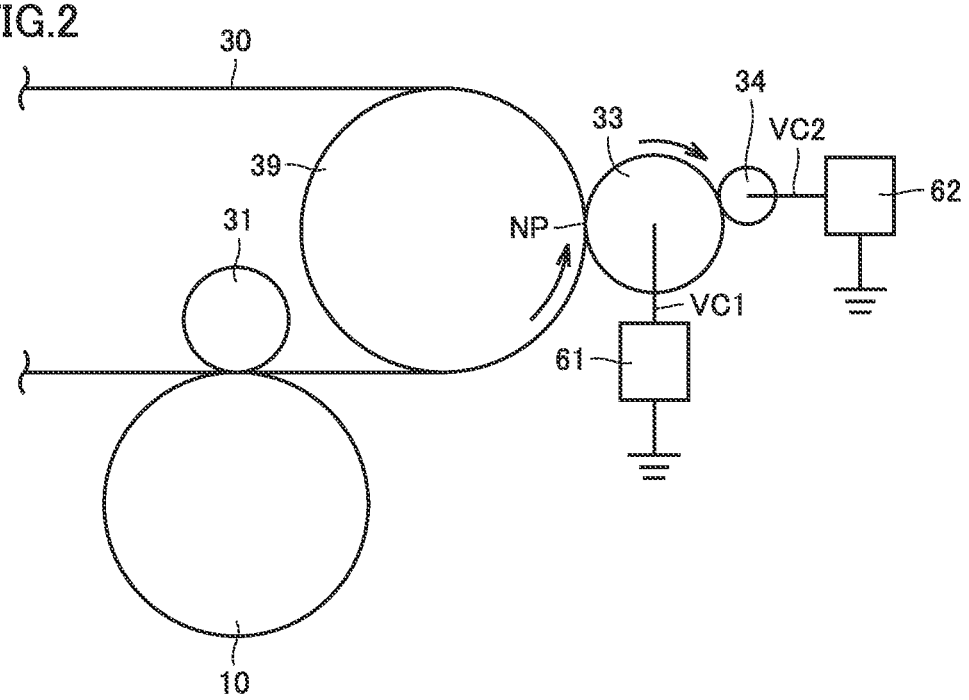
FIG. 2 shows a main portion of the image formation apparatus shown in FIG. 1.

FIG. 2 shows a main portion of image formation apparatus 100. In FIG. 2, image formation apparatus 100 further comprises direct-current power supplies 61 and 62. Direct-current power supply 61 is controlled by control device 51 and applies a control voltage VC1 to secondary transfer roller 33. While sheet S is inserted in a nip NP, control voltage VC1 is set to a large direct-current voltage VP1 opposite in polarity to the toner, whereas while sheet S is not inserted in nip NP, control voltage VC1 is set to a small direct-current voltage VN1 identical in polarity to the toner. For example, when the toner is negative in polarity, direct-current voltage VP1 is a large positive voltage (for example, +1 kV to +2 kV) and direct-current voltage VN1 is a small negative voltage.

When direct-current voltage VP1 opposite in polarity to the toner is applied to secondary transfer roller 33 while sheet S is inserted in nip NP, the toner image on the surface of intermediate transfer belt 30 is transferred to a surface of sheet S. While sheet S is not inserted into nip NP, direct-current voltage VN1 identical in polarity to the toner is applied to secondary transfer roller 33 to suppress adhesion of the toner to the surface of secondary transfer roller 33.

Direct-current power supply 62 is controlled by control device 51 to apply a control voltage VC2 to discharging member 34. When electrically weakly charged toner adheres to the surface of secondary transfer roller 33, control voltage VC2 is set to a large direct-current voltage VN2 identical in polarity to the toner, otherwise control voltage VC2 is set to 0 V. For example, when the toner is negative in polarity, direct-current voltage VN2 is a large negative voltage.

Figure 3:
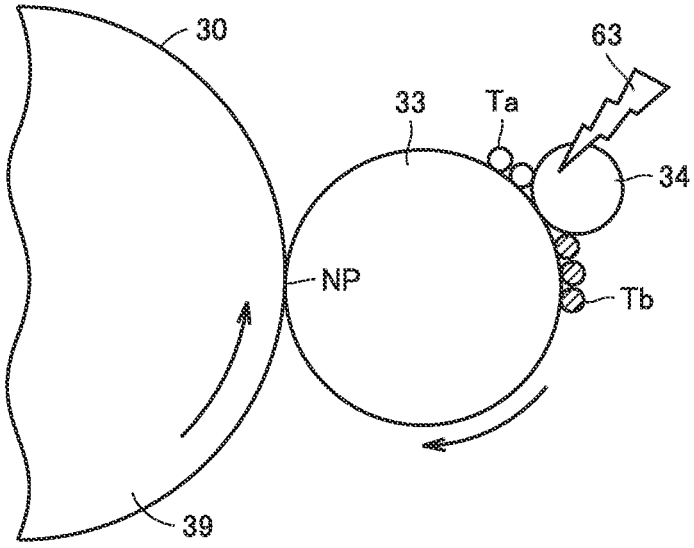
FIG. 3 shows a configuration of a discharging member shown in FIG. 2, and illustrates how it operates.

FIG. 3 shows a configuration of discharging member 34, and illustrates how it operates. In FIG. 3, discharging member 34 is provided at a predetermined position (a second position) downstream of nip NP in the direction in which secondary transfer roller 33 rotates. When one rotation of secondary transfer roller 33 is set to 360 degrees and the position of nip NP is set to 0 degree, discharging member 34 is provided at a position rotated, for example, by 120 degrees downstream of nip NP.

Discharging member 34 is provided in the form of a roller and includes, for example, a rotation shaft, a base layer provided on a circumference of the rotation shaft, and a surface layer provided to cover the outer circumferential surface of the base layer. The rotation shaft is formed of metal, for example, and receives control voltage VC2 from direct-current power supply 62. The base layer is formed of an electrically conductive, elastic body (for example, electrically conductive rubber). The surface layer is formed of electrically conductive resin.

Discharging member 34 is pressed against secondary transfer roller 33 with a predetermined force. Discharging member 34 and secondary transfer roller 33 configure a nip of a predetermined width. Discharging member 34 may be supported so as not to rotate, or it may be supported so as to rotate following secondary transfer roller 33.

Direct-current voltage VN2 is set to a large voltage (e.g., −2 kV to −3 kV) such that an electric discharge 63 is caused in small gaps on opposite sides of the nip between discharging member 34 and secondary transfer roller 33. In other words, in small gaps on opposite sides of the nip between discharging member 34 and secondary transfer roller 33, direct-current voltage VN2 is set to a voltage larger than Paschen's discharge starting voltage.

Therefore, when direct-current voltage VN2 is applied to discharging member 34, electric discharge 63 is caused in small spaces on opposite sides of the nip between discharging member 34 and secondary transfer roller 33. When electrically weakly charged toner Ta adhering to the surface of secondary transfer roller 33 passes between discharging member 34 and secondary transfer roller 33, electrically weakly charged toner Ta is exposed to electric discharge 63 and becomes electrically strongly charged toner Tb negative in polarity.

When direct-current voltage VP1 opposite in polarity to the toner is applied to secondary transfer roller 33 while sheet S is inserted in nip NP, electrically strongly charged toner Tb is electrically attracted to the surface of secondary transfer roller 33 and does not adhere to the back surface of sheet S. This can prevent the toner on the surface of secondary transfer roller 33 from smearing the back surface of sheet S.

FIGS. 4(A) to 4(C) are timing plots representing an operation of the image formation apparatus. More specifically FIG. 4(A) represents a toner image formed on a surface of intermediate transfer belt 30, FIG. 4(B) represents a waveform of control voltage VC1 applied to secondary transfer roller 33, and FIG. 4(C) represents a waveform of control voltage VC2 applied to discharging member 34.

With reference to FIG. 4(A), on the surface of intermediate transfer belt 30, a plurality of (three in the figure) toner images T1, T2, T3 are sequentially formed at predetermined time intervals, and between two toner images T1 and T2, patch images P1 and P2 are formed using toner. Patch images P1 and P2 are arranged in the widthwise direction of intermediate transfer belt 30.

Patch images P1 and P2 are formed for adjusting a toner image in density and pass through nip NP without being transferred to sheet S. Patch images P1 and P2 have their density sensed by optical sensor 45 (see FIG. 1) at a predetermined position downstream of nip NP.

The leading edges of toner images T1, T2, T3 reach nip NP at times t1, t6, t8, respectively, and the trailing edges thereof reach nip NP at times t2, t7, t9 respectively. The leading edges of patch images P1 and P2 both reach nip NP at time t3, and the trailing edges thereof both reach nip NP at time t4.

Three sheets S1, S2, S3 are sequentially supplied to nip NP, as timed to reach it when three toner images T1, T2, T3 do. Toner images T1, T2, T3 and sheets S1, S2, S3 are equal in size, respectively.

While sheets S1, S2 and S3 are inserted in nip NP (for example, for t1 to t2, t6 to t7, and t8 to t9), control voltage VC1 is set to large positive voltage VP1 opposite in polarity to the toner. As a result, toner images T1, T2, T3 on the surface of intermediate transfer belt 30 are transferred onto the surfaces of sheets S1, S2, S3, respectively.

While sheet S is not inserted in nip NP (for example, for t2 to t6, and t7 to t8), control voltage VC1 is set to small negative voltage VN1 identical in polarity to the toner. This suppresses adhesion of toner of patch images P1 and P2 or the like to the surface of secondary transfer roller 33. Note, however, that patch images P1 and P2 do come into contact with secondary transfer roller 33, and a small amount of toner adheres to the surface of secondary transfer roller 33. The toner adhering to the surface of secondary transfer roller 33 includes electrically weakly charged toner Ta (see FIG. 3).

In response to the leading edges of patch images P1 and P2 having reached nip NP, control voltage VC2 is set to large direct-current voltage VN2 (for example, −2 kV to −3 kV) identical in polarity to the toner for a predetermined period of time. FIG. 4(C) shows a case in which the trailing edges of patch images P1 and P2 reach nip NP at time t4, and thereafter when time t5 arrives, control voltage VC2 falls from 0 V to direct-current voltage VN2, and when the leading edge of the second toner image T2 reaches nip NP, or at time t6, control voltage VC2 is raised from direct-current voltage VN2 to 0 V.

When control voltage VC2 is set to direct-current voltage VN2, electric discharge 63 occurs on opposite sides of the nip between discharging member 34 and secondary transfer roller 33. When electrically weakly charged toner Ta adhering to the surface of secondary transfer roller 33 passes between discharging member 34 and secondary transfer roller 33, electrically weakly charged toner Ta is exposed to electric discharge 63 and becomes electrically strongly charged toner Tb negative in polarity (see FIG. 3). Accordingly, when the second sheet S2 inserted in nip NP, and therewhile. i.e., for a period of t6-t7, positive voltage VP1 opposite in polarity to the toner is applied to secondary transfer roller 33, the toner on the surface of secondary transfer roller 33 is electrically attracted to the surface of secondary transfer roller 33. This can prevent the toner on the surface of secondary transfer roller 33 from smearing the back surface of sheet S2.

Figure 4:
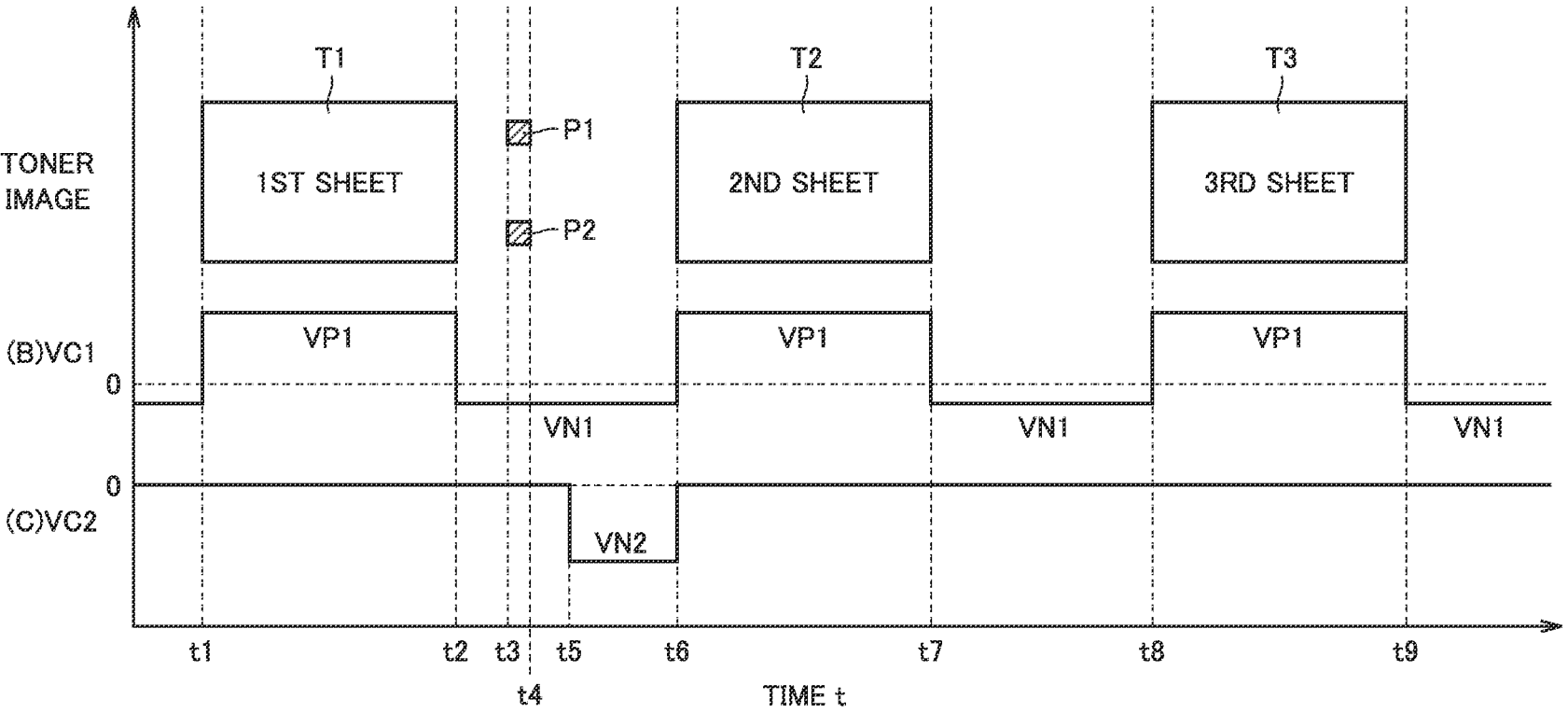
FIG. 4 is timing plots representing an operation of the image formation apparatus shown in FIGS. 1 to 3.
Figure 5A:
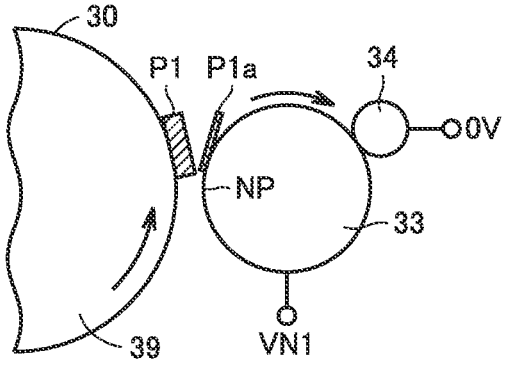
FIGS. 5A, B and C schematically shows an operation of the image formation apparatus shown in FIGS. 1 to 3.
Figure 5B:
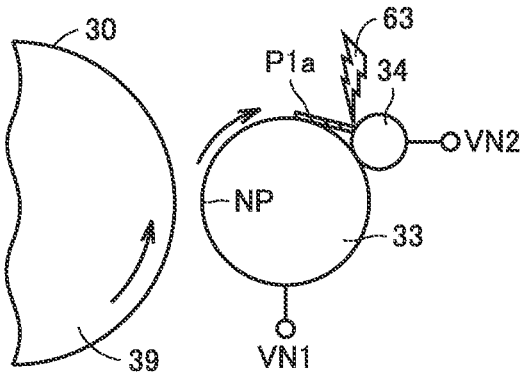
Figure 5C:
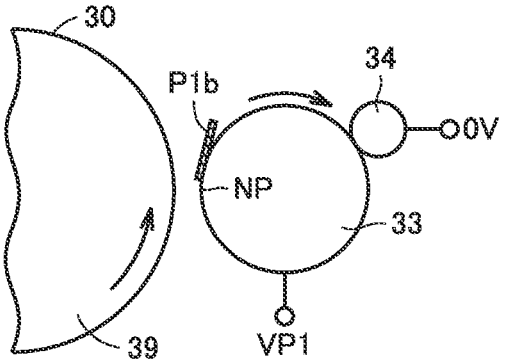

FIGS. 5A to 5C schematically represent an operation of the image formation apparatus. In FIG. 5A, patch image P1 on the surface of intermediate transfer belt 30 comes into contact with the surface of secondary transfer roller 33 at nip NP, and a toner image P1*a* having the same shape as patch image P1 adheres to the surface of secondary transfer roller 33 (see FIG. 4 at times t3 to t5). Toner image P1*a* includes electrically weakly charged toner Ta (see FIG. 3).

In FIG. 5B, before the leading edge of toner image P1*a* reaches discharging member 34, large negative voltage VN2 identical in polarity to the toner is applied to discharging member 34 to cause electric discharge 63 on opposite sides of the nip between discharging member 34 and secondary transfer roller 33 (see FIG. 4 at times t5 to t6). Electrically weakly charged toner Ta included in toner image P1*a* is exposed to electric discharge 63 and thus re-charged to be negative in polarity to be electrically strongly charged toner Tb (see FIG. 3). Thus, toner image P1*a* including electrically weakly charged toner Ta becomes a toner image P1*b* including electrically strongly charged toner Tb.

In FIG. 5C, when sheet S2 is inserted in nip NP and therewhile positive voltage VP1 opposite in polarity to the toner is applied to secondary transfer roller 33, toner image P1*b* is electrically attracted to a surface of secondary transfer roller 33 and sheet S2 is prevented from having its back surface smeared with the toner (see FIG. 4 at times t6 to t7).

Thus, in the first embodiment, direct-current voltage VN2 identical in polarity to toner is applied to discharging member 34 to cause electric discharge 63 to electrically charge toner on a surface of secondary transfer roller 33 to electrically attract the toner to secondary transfer roller 33. This can prevent the toner adhering to secondary transfer roller 33 from smearing the back surface of sheet S. Further, printing can be done while attracting the toner to secondary transfer roller 33, and productivity is not impaired.

While in the first embodiment patch images P1 and P2 used for adjusting a toner image in density are formed between toner images T1 and T2, the present invention is not limited thereto. The present invention is also applicable to forming a patch image in order to: (1) discharge old toner in developing unit 13 and refresh a developing agent; (2) refresh the surface of photoreceptor 10 uniformly; (3) reduce friction between photoreceptor 10 and cleaning blade 17; and (4) reduce friction between intermediate transfer belt 30 and cleaning blade 42. For cases (1) to (4), the patch image is formed to have substantially the same width as intermediate transfer belt 30.

Further, the present invention is also applicable to a case in which patch images P1 and P2 are not formed between toner images T1 and T2. When toner adheres to a surface of secondary transfer roller 33 due to a sheet jam or the like, direct-current voltage VN2 identical in polarity to the toner can be applied to discharging member 34 to make the toner on the surface of secondary transfer roller 33 electrically strongly charged toner Tb. This also allows the toner on the surface of secondary transfer roller 33 to be electrically attracted to secondary transfer roller 33 to prevent the toner adhering to secondary transfer roller 33 from smearing the back surface of sheet S.

While in the first embodiment discharging member 34 is brought into contact with secondary transfer roller 33, discharging member 34 and secondary transfer roller 33 may be disposed in parallel with a predetermined small gap therebetween. In that case, direct-current voltage VN2 is set to a voltage larger than Paschen's discharge starting voltage to cause electric discharge 63 in the gap between discharging member 34 and secondary transfer roller 33. In this exemplary variation, discharging member 34 does not come into contact with secondary transfer roller 33, which can suppress adhesion of toner on the surface of secondary transfer roller 33 to discharging member 34.

Figure 6:
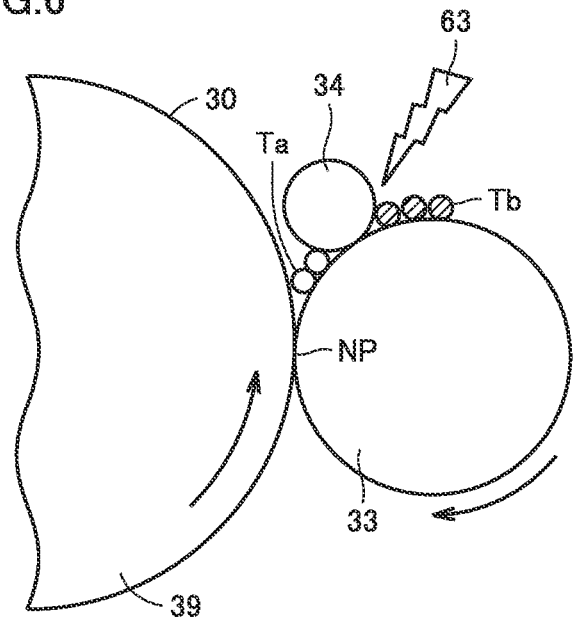
FIG. 6 shows an exemplary variation of the first embodiment.

FIG. 6 is a diagram showing an exemplary variation of the first embodiment in comparison with FIG. 3. Referring to FIG. 6, in this exemplary variation, discharging member 34 is disposed at a position immediately following nip NP in the direction in which secondary transfer roller 33 rotates. In this exemplary variation, electrically weakly charged toner Ta on the surface of intermediate transfer belt 30 can be recharged immediately after electrically weakly charged toner Ta adheres to secondary transfer roller 33. This can reduce a period of time for which electrically weakly charged toner Ta adheres to secondary transfer roller 33, and ensures that the toner is bound to the surface of secondary transfer roller 33.

Figure 7:
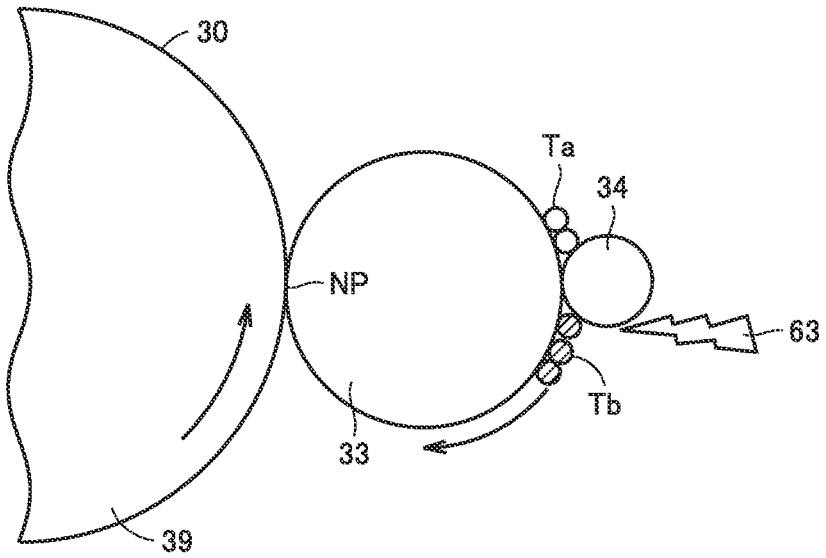
FIG. 7 shows another exemplary variation of the first embodiment.

FIG. 7 is a diagram showing another exemplary variation of the first embodiment in comparison with FIG. 3. With reference to FIG. 7, in this exemplary variation, discharging member 34 is disposed on a side of secondary transfer roller 33 opposite to the position of nip NP. In other words, when one rotation of secondary transfer roller 33 is set to 360 degrees and the position of nip NP is set to 0 degree, discharging member 34 is disposed at a position of 180 degrees. This exemplary variation can maximize a distance between the location where electric discharge 63 occurs and nip NP, and minimize an effect of electric discharge 63 on a toner image or the like having reached nip NP.

Figure 8:
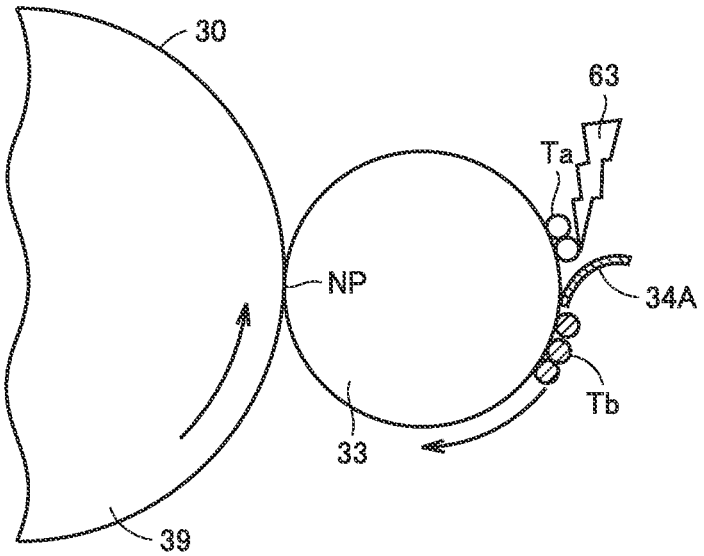
FIG. 8 shows still another exemplary variation of the first embodiment.

FIG. 8 is a diagram showing still another exemplary variation of the first embodiment in comparison with FIG. 7. Referring to FIG. 8, this exemplary variation is different from the exemplary variation of FIG. 7 in that discharging member 34 is replaced with a discharging member 34A.

Discharging member 34A is provided in the form of a sheet and includes, for example, a substrate, a base layer provided on a surface of the substrate, and a surface layer provided on a surface of the base layer. The substrate is formed of metal, for example, and receives control voltage VC2 from direct-current power supply 62. The base layer is formed of an electrically conductive, elastic body (for example, electrically conductive rubber). The surface layer is formed of electrically conductive resin.

Discharging member 3A has the surface layer with a tip end directed downstream in the direction in which secondary transfer roller 33 rotates, and pressed against a surface of secondary transfer roller 33 with a predetermined force. Discharging member 34A has a base end portion supported by a support member (not shown). Control voltage VC2 is applied to the base end portion of the substrate of discharging member 34A.

Discharging member 34A and secondary transfer roller 33 configure a nip having a predetermined width. Direct-current voltage VN2 is set to a large voltage (e.g., −2 kV to −3 kV) such that electric discharge 63 is caused in a small gap near the nip between discharging member 34A and secondary transfer roller 33. In other words, in a small gap near the nip between discharging member 3A and secondary transfer roller 33, direct-current voltage VN2 is set to a voltage larger than Paschen's discharge starting voltage.

When direct-current voltage VN2 identical in polarity to the toner is applied to discharging member MA, electric discharge 63 occurs in a gap between discharging member 3A and secondary transfer roller 33, and when electrically weakly charged toner Ta on the surface of secondary transfer roller 33 passes through the electrically discharging region, it becomes electrically strongly charged toner Tb. This exemplary variation can provide the same effect as the first embodiment, and in addition, reduce the apparatus's cost.

The discharging member may have a shape other than a roller and a sheet. For example, the discharging member may be composed of a wire or a plurality of needles that generates corona discharge. The wire and secondary transfer roller 33 are disposed in parallel with a predetermined space therebetween. The plurality of needles are disposed in the direction of the length of the secondary transfer roller. The tip of each needle and the surface of secondary transfer roller 33 are spaced as predetermined. When direct-current voltage VN2 is applied to the wire or each needle, corona discharge occurs throughout the wire or at the tip of each needle, and negative ions are generated by corona discharge. Electrically weakly charged toner Ta on the surface of secondary transfer roller 33 is turned into electrically strongly charged toner Tb by the negative ions. This exemplary variation can also achieve the same effect as the first embodiment.

Figure 9:
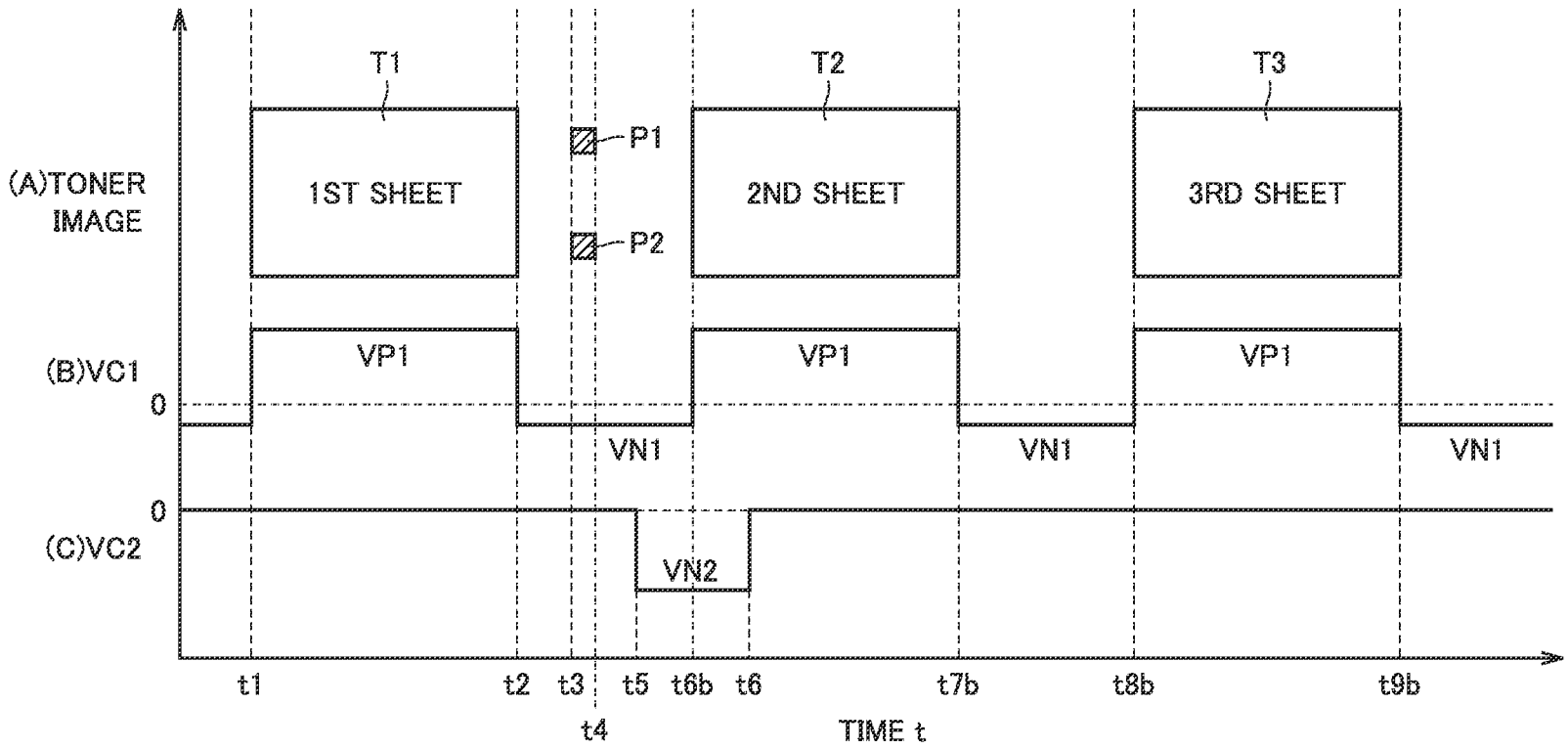
FIG. 9 is timing plots representing still another exemplary variation of the first embodiment.

FIGS. 9(A) to 9(C) are timing plots representing still another exemplary variation of the first embodiment in comparison with FIGS. 4(A) to 4(C). With reference to FIGS. 9(A) to 9(C), this exemplary variation differs from the first embodiment in that transferring the second toner image T2 is started while direct-current voltage VN2 is applied to discharging member 34 (or at time t6*b*). In other words, an interval between toner images T1 to T3 (that is, a sheet interval) is reduced and direct-current voltage VN2 is continuously applied to discharging member 34 until a predetermined period of time elapses after transferring the second toner image T2 is started. In FIGS. 9(A) and 9(B), times t6, t7, t8, and t9 in FIGS. 4(A) and 4(B) are advanced to times t6, t7*b*, t8*b*, and t9*b*, respectively. In this exemplary variation, an interval between toner images T1-T3 can be reduced, and toner images T1-T3 can be formed at an increased speed.

Second Embodiment

FIGS. 10(A) to 10(C) are timing plots representing an operation of the image formation apparatus according to a second embodiment of the present invention in comparison with FIGS. 4(A) to 4(C). With reference to FIGS. 10(A) to 10(C), the present image formation apparatus applies a large direct-current voltage VN3 identical in polarity to the toner to secondary transfer roller 33 during a cleaning period TC between time t7, at which the trailing edge of the second toner image T2 reaches nip NP, and time t9, at which the leading edge of the third toner image T3 reaches nip NP. When the toner is negative in polarity, direct-current voltage VN3 is a large negative voltage.

Figure 10:
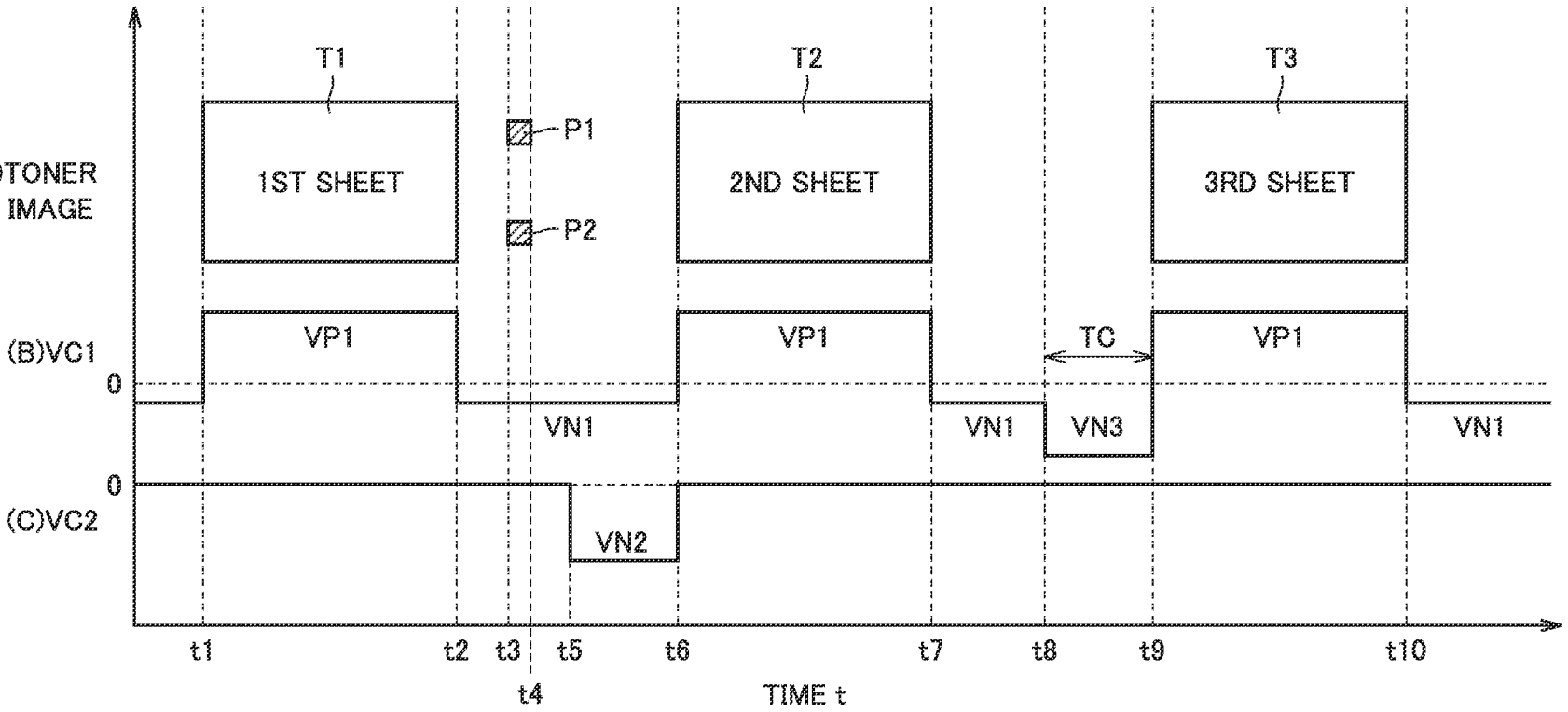
FIG. 10 is timing plots representing an operation of the image formation apparatus according to a second embodiment of the present invention.
Figure 11:
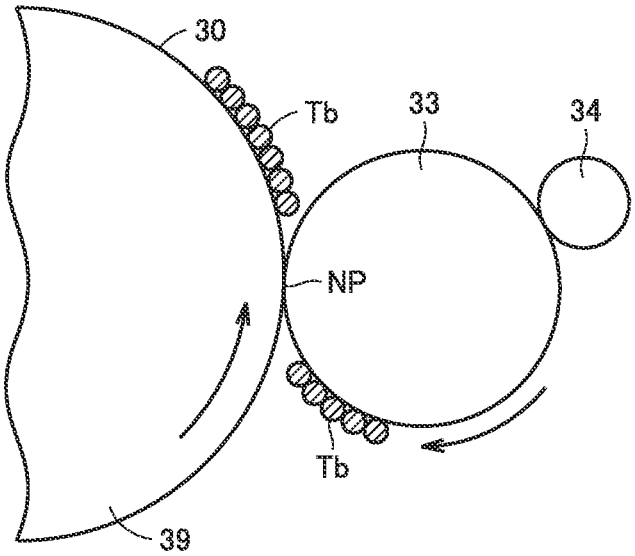
FIG. 11 schematically shows an operation of the image formation apparatus shown in FIG. 10.

When large direct-current voltage VN3 identical in polarity to the toner is applied to secondary transfer roller 33, then, as shown in FIG. 11, electrically strongly charged toner Tb on the surface of secondary transfer roller 33 receives an electrical repulsive force, and moves to the surface of intermediate transfer belt 30. Cleaning period TC is set to a period of time equal to or longer than a period of time required for secondary transfer roller 33 to rotate once. In FIGS. 10(A) to 10(C), cleaning period TC is set as the latter half of the period between time t7 and time t9, that is, the period between time t8 and time t9. Thus, in cleaning period TC, the toner adhering to the surface of secondary transfer roller 33 moves to the surface of intermediate transfer belt 30, and the surface of secondary transfer roller 33 is thus cleaned.

The second embodiment can achieve the same effect as the first embodiment and in addition, prevent deposition of toner on the surface of second transfer roller 33. In addition, the toner is moved while sheet S is not inserted in nip NP (that is, for a period of time between toner images T2 and T3), and sheet S will never have the back surface smeared with the toner.

Figure 12:
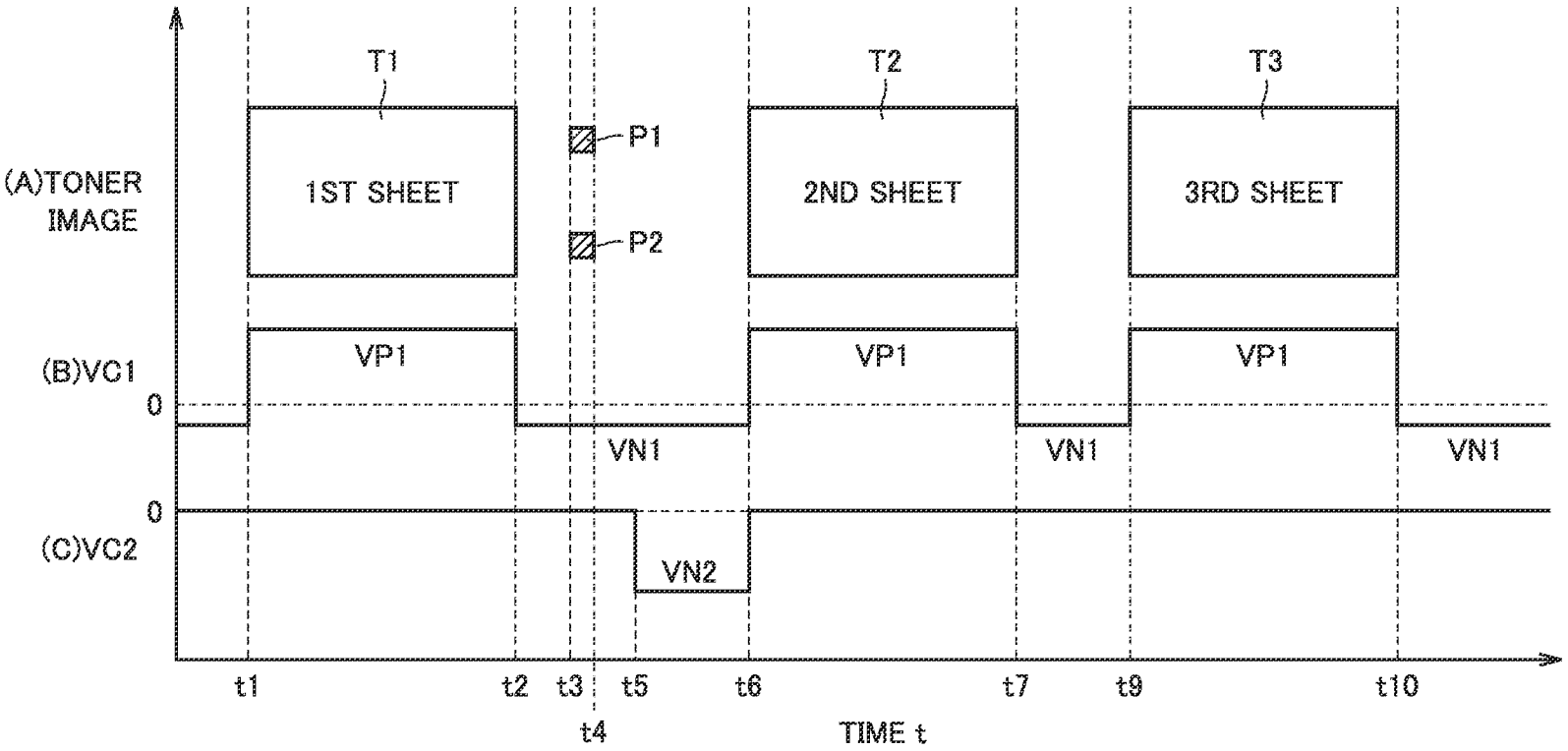
FIG. 12 is timing plots representing an exemplary variation of the second embodiment.
Figure 13:
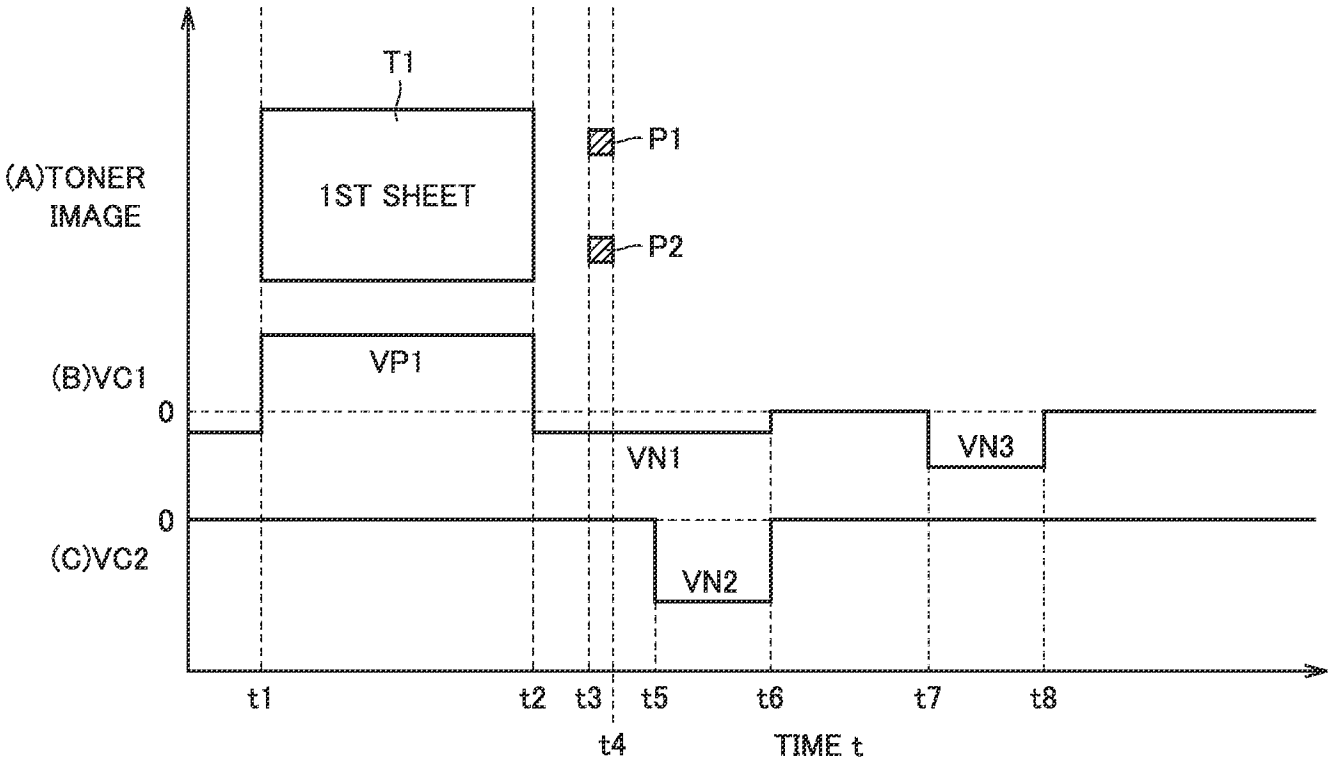
FIG. 13 is timing plots representing an operation of the image formation apparatus according to a third embodiment of the present invention.

FIGS. 12(A) to 12(C) are timing plots representing an exemplary variation of the second embodiment in comparison with FIGS. 10(A) to 10(C). With reference to FIGS. 12(A) to 12(C), in this exemplary variation, when secondary transfer roller 33 is not cleaned between two toner images T2 and T3, a period of time between toner images T2 and T3 is reduced. Thus, in this exemplary variation, toner images T1 to T3 can be formed in a reduced period of time.

Third Embodiment

FIGS. 3(A) to 13(C) are timing plots representing an operation of the image formation apparatus according to a third embodiment of the present invention in comparison with FIGS. 10(A) to 10(C). The third embodiment shows a case in which after toner image T1 and patch images P1 and P2 are formed, no additional toner image is formed and printing is stopped (that is, an end of JOB).

In FIGS. 13(A) to 13(C), toner image T1 and patch images P1 and P2 are formed on the surface of intermediate transfer belt 30. The leading edge of toner image T1 reaches nip NP at time t1, and the trailing edge thereof reaches nip NP at time t2. The leading edges of patch images P1 and P2, respectively, both reach nip NP at time t3, and the trailing edges of patch images P1 and P2, respectively, both reach nip NP at time t4.

One sheet S1 is supplied to nip NP, as timed to coincide with toner image T1. Toner image T1 and sheet S1 are of the same size. While sheet S1 is inserted in nip NP, i.e., for a period of time of t1 to t2, control voltage VC1 is set to large positive voltage VP1 opposite in polarity to the toner. Thus, toner image T1 on the surface of intermediate transfer belt 30 is transferred to a surface of sheet S1.

While sheet S1 is not inserted in nip NP, i.e., for a period of time of t2 to t6, control voltage VC1 is set to small negative voltage VN1 identical in polarity to the toner. This suppresses adhesion of toner of patch images P1 and P2 or the like to the surface of secondary transfer roller 33. Note, however, that patch images P1 and P2 do come into contact with secondary transfer roller 33, and a small amount of toner adheres to the surface of secondary transfer roller 33. The toner adhering to the surface of secondary transfer roller 33 includes electrically weakly charged toner Ta (see FIG. 3).

In response to the leading edges of patch images P1 and P2 having reached nip NP, control voltage VC2 is set to large direct-current voltage VN2 (for example, −2 kV to −3 kV) identical in polarity to the toner only for a predetermined period of time (of times t5-t6). More specifically, the trailing edges of patch images P1 and P2 reach nip NP at time t4, and thereafter when time LS arrives, control voltage VC2 falls from 0 V to direct-current voltage VN2, and thereafter when a predetermined period of time elapses, or when time t6 arrives, control voltage VC2 is raised from direct-current voltage VN2 to 0 V. Further, at time t6, control voltage VC1 is raised from direct-current voltage VN1 to 0 V.

When control voltage VC2 is set to direct-current voltage VN2, electric discharge 63 occurs on opposite sides of the nip between discharging member 34 and secondary transfer roller 33. When electrically weakly charged toner Ta adhering to the surface of secondary transfer roller 33 passes between discharging member 34 and secondary transfer roller 33, electrically weakly charged toner Ta is exposed to electric discharge 63 and becomes electrically strongly charged toner Tb negative in polarity (see FIG. 3).

After a predetermined period of time elapses, or when time t7 arrives, control voltage VC1 falls from 0 V to large negative voltage VN3 identical in polarity to the toner. When control voltage VC1 is set to negative voltage VN3, electrically strongly charged toner Tb on the surface of secondary transfer roller 33 moves to the surface of intermediate transfer belt 30, and the toner on the surface of secondary transfer roller 33 is thus removed. The toner having moved to the surface of intermediate transfer belt 30 is removed by cleaning blade 42 located downstream, and discarded.

The third embodiment allows the toner on the surface of secondary transfer roller 33 to be sufficiently removed, and ensures that in subsequent printing, sheet S can be prevented from having a back surface smeared with toner. In addition, when printing is finished, the toner on secondary transfer roller 33 is removed, and a waiting time and hence impaired productivity can also be avoided.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image formation apparatus comprising:

an image carrier rotatably driven and having a surface on which a toner image is formed;

a first transfer roller cooperating with a surface of the image carrier to form a nip at a first position in a direction in which the image carrier rotates;

a discharging member provided at a second position downstream of the nip in a direction in which the first transfer roller rotates;

a first power supply that applies a first voltage opposite in polarity to toner to the first transfer roller to transfer the toner image to a recording medium when the recording medium is inserted in the nip; and a second power supply that applies a second voltage identical in polarity to the toner to the discharging member to cause an electric discharge to electrically charge the toner on a surface of the first transfer roller to electrically attract the toner to the first transfer roller, wherein first and second toner images are sequentially formed on the surface of the image carrier and a patch image using the toner is formed between the first and second toner images, and the second power supply applies the second voltage to the discharging member in response to the patch image's leading edge having reached the nip.

2. The image formation apparatus according to claim 1, wherein the discharging member and the first transfer roller are spaced from each other.

3. The image formation apparatus according to claim 1, wherein the second voltage is set such that a voltage of the discharging member with respect to the first transfer roller is higher than Paschen's discharge starting voltage.

4. The image formation apparatus according to claim 1, wherein the second position is adjacent to the nip or a position on a side of the first transfer roller opposite to the nip.

5. The image formation apparatus according to claim 1, wherein the discharging member is in a form of a roller or in a form of a sheet.

6. The image formation apparatus according to claim 1, wherein when a recording medium is not inserted in the nip, the first power supply applies a third voltage identical in polarity to the toner to the first transfer roller to suppress adhesion of the toner on the surface of the image carrier to the first transfer roller.

7. The image formation apparatus according to claim 1, wherein when a recording medium is not inserted in the nip and the toner on the surface of the first transfer roller is cleaned, the first power supply applies a fourth voltage identical in polarity to the toner to the first transfer roller to move the toner on the surface of the first transfer roller to the surface of the image carrier.

8. The image formation apparatus according to claim 1, wherein in response to the second toner image's leading edge having reached the nip, the second power supply stops applying the second voltage to the discharging member.

9. The image formation apparatus according to claim 1, wherein when the second toner image's leading edge reaches the nip and thereafter a predetermined period of time elapses before the second toner image's trailing edge reaches the nip, the second power supply stops applying the second voltage to the discharging member.

10. The image formation apparatus according to claim 1, wherein after the first toner image's trailing edge reaches the nip before the second toner image's leading edge reaches the nip, the first power supply applies a third voltage identical in polarity to the toner to the first transfer roller to suppress adhesion of the toner on the surface of the image carrier to the first transfer roller.

11. The image formation apparatus according to claim 10, wherein a third toner image is further formed and the patch image is not formed between the second and third toner images, and when cleaning the first transfer roller, the first power supply applies a fourth voltage identical in polarity to the toner and larger than the third voltage to the first transfer roller to move the toner on the surface of the first transfer roller to the surface of the image carrier in a cleaning period during a period corresponding to an interval between the second and third toner images.

12. The image formation apparatus according to claim 11, wherein the cleaning period is set to a second period of time equal to or longer than a first period of time required for the first transfer roller to rotate once.

13. The image formation apparatus according to claim 12, wherein when the first transfer roller is cleaned, a period of time between the first toner image's trailing edge and the second toner image's leading edge is set to a third period of time equal to or longer than the first period of time, and when the first transfer roller is not cleaned, a period of time between the second toner image's trailing edge and the third toner image's leading edge is set to a fourth period of time shorter than the first period of time.

14. The image formation apparatus according to claim 11, wherein when forming a toner image on the surface of the image carrier is finished, the second power supply applies the third voltage to the discharging member to electrically charge the toner on the surface of the first transfer roller and the first power supply applies the fourth voltage to the first transfer roller to move the toner on the surface of the first transfer roller to the surface of the image carrier.

15. The image formation apparatus according to claim 1, comprising:

a cleaner provided at a third position downstream of the first position in the direction in which the image carrier rotates to remove toner from the surface of the image carrier;

an image forming unit provided at a fourth position downstream of the third position and upstream of the first position in the direction in which the image carrier rotates to form a toner image;

a second transfer roller that transfers a toner image generated by the image forming unit to the surface of the image carrier; and a sheet feeding device that supplies a recording medium to the nip.

16. The image formation apparatus according to claim 1, wherein the image carrier is an intermediate transfer belt.

17. An image formation apparatus comprising:

an image carrier rotatably driven and having a surface on which a toner image is formed;

a first transfer roller cooperating with a surface of the image carrier to form a nip at a first position in a direction in which the image carrier rotates;

a discharging member provided at a second position downstream of the nip in a direction in which the first transfer roller rotates;

a first power supply that applies a first voltage opposite in polarity to toner to the first transfer roller to transfer the toner image to a recording medium when the recording medium is inserted in the nip; and a second power supply that applies a second voltage identical in polarity to the toner to the discharging member to cause an electric discharge to electrically charge the toner on a surface of the first transfer roller to electrically attract the toner to the first transfer roller, wherein the first power supply and the second power supply are operable simultaneously so that two different voltages can be simultaneously applied to the first transfer roller and the discharging member.

18. The image formation apparatus according to claim 17, wherein first and second toner images are sequentially formed on the surface of the image carrier and a patch image using the toner is formed between the first and second toner images, and the second power supply applies the second voltage to the discharging member in response to the patch image's leading edge having reached the nip.

* * * * *